United States Patent [19]

Nickola

[11] Patent Number: 4,624,895

[45] Date of Patent: Nov. 25, 1986

[54] ALUMINUM COATED LOW-ALLOY STEEL FOIL

[75] Inventor: Richard A. Nickola, Highland, Ind.

[73] Assignee: Inland Steel Company, Chicago, Ill.

[21] Appl. No.: 617,077

[22] Filed: Jun. 4, 1984

[51] Int. Cl.[4] ..... B32B 15/04

[52] U.S. Cl. ..... 428/335; 148/6.27; 148/6.11; 427/431; 427/329; 427/434.2; 427/436; 428/607; 428/653; 428/939; 428/457

[58] Field of Search ..... 427/401, 431, 405, 329, 427/367, 369, 360, 434.2, 436; 428/607, 653, 939, 457; 148/6.11, 6.27

[56] References Cited

U.S. PATENT DOCUMENTS

| | | | |
|---|---|---|---|
| 2,170,361 | 4/1938 | Whitfield . | |
| 2,697,869 | 4/1948 | Kingston et al. . | |
| 3,305,323 | 2/1963 | Smith et al. . | |
| 3,881,880 | 5/1975 | Gomersall | 427/401 |
| 3,881,881 | 5/1975 | Kim | 427/431 |
| 3,881,882 | 5/1975 | Hughes et al. | 427/431 |
| 3,925,579 | 12/1975 | Flincham et al. | 427/431 |
| 14,141,760 | 2/1979 | Baldi | 427/405 |
| 4,144,378 | 3/1979 | Kim | 427/432 |
| 4,248,908 | 2/1981 | Nickola | 427/329 |
| 4,279,782 | 7/1981 | Chapman et al. . | |
| 4,517,229 | 5/1985 | Nickola et al. | 428/653 |

*Primary Examiner*—Edith Buffalow

*Attorney, Agent, or Firm*—Marshall, O'Toole, Gerstein, Murray & Bicknell

[57] ABSTRACT

A low-titanium alloy steel foil having a cold rolled metallic aluminum hot-dip coated surface which is adapted for growing a thick surface coating of spine-like whiskers of aluminum oxide suitable for retaining a coating of a metallic catalyst, which is formable at room temperature without annealing, and which exhibits good resistance to oxidation at temperatures up to 1149° C. (2100° F.).

11 Claims, 2 Drawing Figures

ALUMINUM COATED LOW-ALLOY STEEL FOIL

Figure 1:
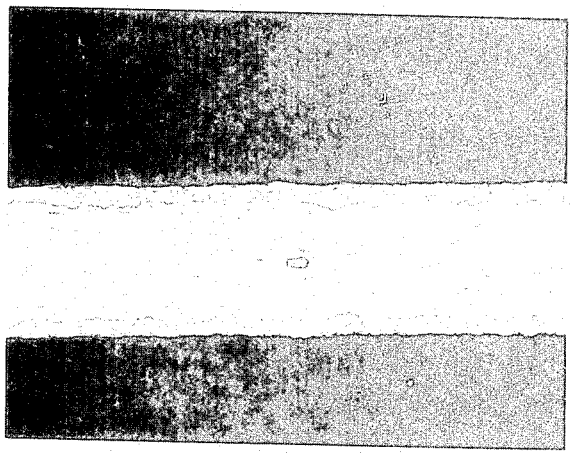

The present invention relates generally to an aluminum coated low alloy steel foil and, more particularly, to a hot dip aluminum coated low-titanium alloy steel foil which is formable at room temperature with good high temperature resistant properties and which preferably is adapted for growing a thick layer of spine-like whiskers of aluminum oxide suitable for retaining a surface coating of a metal catalyst for use in a monolithic catalytic converter of an internal combustion engine.

The worldwide requirements to reduce atmospheric pollution by automotive and the like exhaust gases have created a great demand for a more efficient and less expensive catalytic converter for removing atmospheric pollutants from the exhaust gases. The Chapman et al U.S. Pat. No. 4,279,782 describes an improved method of making a catalyst support for use in a catalytic converter which employs a steel foil having a thickness of about 0.051 mm (0.002 inches). The steel foil must exhibit good oxidation resistance at high temperature when exposed to exhaust gases and must be adapted for growing an adherent thick layer of spine-like whiskers of aluminum oxide for supporting a coating of gamma alumina powder dispersed in alumina gel which contains thereon a noble metal catalyst.

The steel foil in the Chapman et al patent is made by peeling the foil as an endless strip from a rotating billet of stainless steel containing 15–25% chromium, 3–6% aluminum, and optionally up to 1% of a rare earth metal with the balance essentially iron. The Chapman et al whisker-growing steel foil requires using a large amount of relatively expensive chromium which adds appreciably to the cost of the catalyst support structure. The chromium-containing stainless steel foil has limited formability in the as formed condition and requires annealing before it can be made into a catalyst support structure.

Heretofore, a low cost high temperature resistant steel foil having an aluminum surface coating has not been commercially available. The Smith et al U.S. Pat. No. 3,214,820 discloses a method of making steel foils by cold rolling a coated steel strip plated with a protective metal but making foil from hot-dip coated steel was where the coating metal formed a subsurface intermetallic layer between the steel base and the metallic surface coating. Smith et al fail to disclose a method of producing an adherent uniform aluminum coated steel foil by cold rolling a hot-dip aluminum coating steel strip, because of the formation of a hard brittle iron-aluminum intermetallic layer which is inherently formed when a steel strip is immersed in a hot-dip coating bath even when the bath contains a metal addition such as silicon. Smith et al found that even when a hot dip tin coated steel strip having an intermetallic layer was cold rolled to foil thickness which requires a reduction in thickness in excess of about 70%, the hard brittle intermetallic layer was found to prevent forming a uniform smooth surface on the steel foil (See Smith et al U.S. Pat. No. 3,214,820). Furthermore, when a hot-dip aluminum coated steel strip was reduced in excess of about 50% of its original thickness so as to pulverize a subsurface intermetallic layer, the coating was found to be readily separated from the steel (see Whitfield U.S. Pat. No. 2,170,361).

It is therefore an object of the present invention to provide a method of producing economically a cold reduced hot-dip aluminum coated low alloy steel foil which is formable at room temperature without annealing and is resistant to damage by oxidation at elevated temperature up to about 1150° C. (2100° F.).

It is a further object of the present invention to provide uniform smooth cold rolled hot-dip aluminum coated steel foil which is formable at room temperature without impairing the integrity of the aluminum coating.

It is still another object of the present invention to provide a cold rolled hot-dip aluminum coated steel foil which has good resistance to oxidation and corrosion when exposed to automotive exhaust gases at temperatures between about 899° C. (1650° F.) and 1000° C. (1832° F.).

It is also an object of the present invention to provide in an economical manner a cold reduced hot-dip aluminum coated low alloy stabilized steel foil which is adapted for growing an adherent thick surface coating of spine-like whiskers of aluminum oxide.

It is a still further object of the present invention to provide a cold rolled hot dip aluminum coated steel foil which is resistant to oxidation and corrosion when heated to an elevated temperature in an atmosphere of automotive exhaust gases and is adapted for growing a thick surface coating of spine-like whiskers of aluminum oxide.

Figure 2:
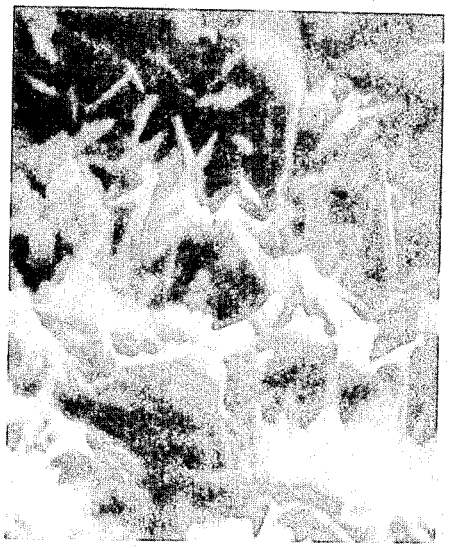

Other objects of the present invention will be apparent to those skilled in the art from the detailed description and claims to follow when read in conjunction with the accompanying drawing wherein:

FIG. 1 is a photomicrograph at 500× magnification and nital etch of a cross section of about 0.051 mm (0.002 inch) thick aluminum hot-dip coated cold rolled steel foil having on each side an aluminum coating about 5.1 μm (0.0002 inches) thick formed by cold rolling a hot-dip aluminum coated low-titanium alloy stabilized low-carbon steel strip about 0.51 mm (0.020 inches) thick and reduced about 90 percent on a Sendzimir cold rolling mill; and FIG. 2 is a photomicrograph at 10,000× magnification showing a thick growth of spine-like whiskers of aluminum oxide formed on the surface of the hot-dip aluminum coated steel foil of FIG. 1.

Applicant has found that a hot-dip aluminum coated steel foil can be produced so as to achieve one or more of the foregoing objects of the present invention by applying with conventional continuous in-line hot-dip aluminum coating apparatus a hot-dip aluminum coating having a thickness of between about 25.4 um and about 76 μm (0.001 and 0.003 inches) and providing between about 6 and 12 wt. percent aluminum on a low-titanium alloy stabilized lowcarbon steel strip having a thickness of about 0.25 mm and about 0.76 mm (0.010 inches and 0.030 inches) and cold reducing the hot-dip aluminum coated low-titanium alloy steel strip without annealing to effect about an 85–95 percent reduction in thickness of the aluminum coated steel strip and provide an aluminum coated steel foil having a thickness preferably between about 0.038 mm and about 0.089 mm (0.0015 and 0.0035 inches).

In order to provide a low cost aluminum coated steel foil which is formable at room temperatures with good high temperature resistant properties, which has whisker growing properties suitable for supporting a catalytic coating in a monolithic catalytic converter and which has other industrial applications requiring resistance to oxidation, it has been found necessary to form the steel strip from a stabilized low carbon steel and preferably a low-titanium alloy stabilized low-carbon steel. The low-titanium alloy steel is preferably a steel which has been killed to remove free oxygen, such as an aluminum killed steel. The carbon content of the low-titanium alloy steel is generally between about 0.02 wt. % and 0.10 wt. % carbon, although a vacuum degassed steel having less than 0.02 wt. % carbon can be used. The low-titanium low carbon steel should have sufficient titanium to combine with all carbon, oxygen, and nitrogen in the steel and, in addition, sufficient titanium to provide a small excess of uncombined titanium, preferably at least about 0.02 wt. %. The titanium content of the steel will always be less than about 1.0 wt. % and will generally not exceed about 0.6 wt. %. The titanium in the stabilized steel in addition to improving the high temperature oxidation resistance of the aluminum coated steel also increases the high temperature strength of the steel by forming titanium carbide and imparts improved cold rolling and the room temperature ductility properties to the hot-dip aluminum coated steel strip and foil.

A typical low-titanium alloy stabilized low-carbon steel suitable for forming a hot-dip aluminum coated steel foil in accordance with the present invention has the following composition on a weight basis: 0.04% carbon, 0.50% titanium, 0.20–0.50% manganese, 0.012% sulfur, 0.010% phosphorus, 0.05% silicon, 0.020–0.090% aluminum, and the balance essentially iron with incidental impurities.

In forming a low cost aluminum coated steel foil by cold rolling a hot-dip aluminum coated low-titanium alloy stabilized steel strip, the thickness of the steel strip and the aluminum coating therein are critical and both must be carefully controlled. Thus, to hot-dip aluminum coat a steel strip on production-type in-line continuous aluminum coating apparatus, it is essential that the steel strip be sufficiently thick to withstand the stresses of being conveyed through the continuous hot-dip coating apparatus, but not so thick as to make it impossible to reduce economically the coated strip to a steel foil gauge not substantially below about 0.038 mm nor above about 0.089 mm (0.0015 and 0.0035 inches) by effecting about a 90% reduction in thickness of the hot-dip aluminum coated steel strip.

A further important limitation on the thickness of the steel strip to be hot-dip coated on a Sendzimir-type hot-dip coating line is the requirement that the temperature of the strip, after cleaning surface preparation, be adjusted to the temperature of the aluminum hot-dip coating bath before the strip is immersed in the bath while the strip is traveling at a sufficiently high line speed to form a hot-dip aluminum coating having a coating thickness which is required to provide extended high temperature oxidation resistance to the aluminum coated steel foil.

A steel strip having a thickness of between about 0.25 mm (0.010 inches) and 0.76 mm (0.030 inches) has been found to meet the foregoing requirements and be suitable for hot-dip aluminum coating on the continuous inline hot-dip aluminum coating apparatus such as a Sendzimir-type continuous hot-dip coating line adapted to move the steel strip at a line speed of about 280 feet per minute and thereafter being cold reduced to effect about an 85–95% reduction in thickness so as to provide an aluminum coated steel foil having a thickness of between about 0.038 mm (0.0015 inches) and about 0.089 mm (0.0035 inches). The aluminum hot-dip coated steel strip can be cold reduced in one or more passes through a cold rolling mill, such as the Sendzimir cold rolling mill.

It has also been found that in order for the aluminum coated foil to exhibit good oxidation resistance for extended use, as in a catalytic converter, the aluminum hot-dip coating on the steel strip must be sufficiently thick to provide in the finished foil product a minimum of about 6% aluminum based on the weight of the coated foil and preferably between about 6–12% by weight aluminum. Since the steel strip and the hot-dip aluminum coating are reduced in substantially the same proportion when cold rolled to effect about a 90% reduction in the thickness of the coated strip, a steel strip having a thickness before hot-dip coating of between about 0.25 mm (0.010 inches) and about 0.76 mm (0.030 inches) should be provided on each side with an aluminum hot-dip coating having a thickness of at least 25.4 μm (0.001 inches) and preferably about 51 μm (0.002 inches) in order to provide the strip with a minimum of about 6 wt. % aluminum. The finished foil will have an aluminum coating thickness on each side of from about 3.7 μm (0.00015 inch) to about 7.6 μm (0.0003 inch). For example, after about a 90% cold reduction in thickness of a hot-dip aluminum coated steel strip having a thickness of about 0.51 mm (0.020 inches), the cold rolled aluminum coating on each side of the foil is about 5.1 μm (0.0002 inches) thick and provides an aluminum concentration of about 6 wt. % based on the weight of the aluminum coated steel foil (See FIG. 1).

The hot-dip aluminum coating applied to the steel strip is preferably a Type I aluminum coating which contains aluminum with about 5–12 wt. % silicon and wherein the silicon prevents the formation of an objectionably thick subsurface iron-aluminum intermetallic layer. Because of the severe cold reduction required to reduce the steel strip to steel foil gauge, the intermetallic layer is broken up into small fragments and uniformly dispersed throughout the aluminum coating. It is possible, though not preferred, to apply a Type II aluminum hot-dip coating to the stabilized steel strip.

As an example of forming an aluminum coated steel foil according to the present invention, a low-titanium alloy stabilized low-carbon aluminum killed steel was formed into a steel strip having a thickness of about 0.43 mm (0.017 inches). The stabilized low-carbon aluminum killed steel had the following approximate composition:

| | Wt. Percent |
|---|---|
| Carbon | 0.04 |
| Manganese | 0.25 |
| Phosphorus | 0.009 |
| Sulfur | 0.012 |
| Silicon | 0.06 |
| Molybdenum | 0.005 |
| Aluminum | 0.060 |
| Titanium | 0.50 |
| Total residual of Cu, Ni, Sn, Cr | 0.20 |
| Iron | Balance |

The stabilized steel strip after cleaning was immersed in a hot-dip Type I aluminum coating bath having a temperature of 694° C. (1280° F.) on a Sendzimir-type continuous coating line having a line speed of 280 feet per minute to provide both sides thereof with a hot-dip aluminum coating having a thickness of about 38<μm (0.0015 inches). The hot-dip aluminum coated steel strip was cold rolled on a Sendzimir cold rolling mill to a steel foil thickness of about 0.051 mm (0.002 inches) in four passes, 43.6% in the first, 45.5% in the second, 45.0% in the third, and 39.4% in the fourth, for a total of about 90% reduction in thickness without intermediate annealing. Metallographic examination of the steel foil indicated a uniform aluminum surface coating on both sides, approximately 4.6–5.1 μm (0.00018–0.0002 inches) with intermetallic subsurface iron-aluminum aluminum compound layer completely fractured and randomly redistributed throughout the aluminum coating (See FIG. 1). Theoretically, the aluminum in the coatings was sufficient, if fully diffused throughout the cross section of the foil when heated at an elevated temperature, to form an iron aluminum diffusion alloy containing about 6% aluminum. Bulk chemical analyses of the hot-dip aluminum coated foil after diffusion showed 6.4 wt. % aluminum, 0.8 wt. % silicon, and 0.40 wt. % titanium.

The aluminum coated steel foil when heated in air at 1149° C. (2100° F.) for 96 hours exhibits a weight gain of no more than 1 mg/cm$^2$, has good high temperature resistance at 1000° C. (1832° F.) and, when given a 180° 1-T bend at room temperature, the aluminum surface coating was not ruptured.

The as-cold-rolled aluminum coated steel foil is well adapted for use as a substitute for "321 stainless steel" foil for wrapping tools which are heated at an elevated temperature without being enclosed in a protective non-oxidizing atmosphere. The hot-dip aluminum coated steel foil has the required formability at room temperature to form a protective wrapper or enclosure for the tools and is able to withstand heat treating temperatures up to about 1149° C. (2100° F.). The aluminum coating on the foil acts as a "getter" to remove oxygen from within the enclosure and prevents objectionable oxidation and decarburization of the surface of the tools during the heat treating cycle.

When the aluminum coated steel foil is used for a catalytic support structure in a catalytic converter, the steel foil is corrugated longitudinally to provide gas passages when coiled. The aluminum coated foil is preconditioned for whisker growth by preheating in a dry carbon dioxide atmosphere for one to four minutes at 900° C. (1652° F.) and then heated in air for 8 hours at 925° C. (1700° F.) to grow the spine-like whisker surface coating (See FIG. 2). A coating of gamma aluminum oxide powder dispersed in an aqueous alumina gel-noble metal catalyst is applied to the spine-like whisker coated surface of the foil as described in U.S. Patent No. 4,279,782.

I claim:

1. A cold rolled aluminum coated steel foil having a thickness (not substantially below) about 0.038 mm (0.0015 inches) and up to about 0.089 mm (0.0035 inches) formed from a hot-dip aluminum coated low-titanium alloy stabilized low-carbon steel sheet between about 0.25 mm (0.010 inches) and about 0.76 mm (0.030 inches) thick and having an aluminum coaitng on each surface of said foil which is between about 3.7 μm (0.00015 inches) and about 7.6 μm (0.0003 inches) thick with the aluminum in said coatings comprising between about 6 and 12 wt. percent aluminum based on the weight of said foil, said cold rolled aluminum coated steel foil having metallic iron-aluminum intermetallic compound formed during hot-dip coating of said sheet broken into small fragments and uniformly distributed throughout the cold rolled aluminum coating, and said aluminum coated steel foil characterized by being formable at room temperature without annealing and being resistant to oxidation at temperatures up to about 1149° C. (2100° F.).

2. A cold rolled aluminum coated steel foil as in claim 1, wherein said stabilized low-carbon steel has all the carbon, oxygen, and nitrogen in the steel chemically combined with titanium and having in the steel an excess of at least about 0.02 wt. % uncombined titanium.

3. A cold rolled aluminum coated steel foil as in claim 1, wherein said stabilized low carbon steel has a carbon content of less than 0.10 wt. % carbon and a titanium content at least about 0.40 but less than 1.0 wt. %.

4. A cold rolled aluminum coated steel foil as in claim 1, wherein said stabilized low-carbon steel has a carbon content of about 0.04 wt. % and a titanium content of about 0.50%.

5. A cold rolled aluminum coated steel foil as in claim 1, wherein said stabilized low-carbon steel is a low-titanium alloy aluminum killed steel.

6. A cold rolled aluminum coated steel foil as in claim 1, wherein said hot-dip cold rolled aluminum coating is an alloy of aluminum and 5–12 wt. % silicon.

7. A method of forming a room temperature formable hot-dip aluminum coated steel foil comprising (1) forming a strip of low-titanium alloy stabilized low-carbon steel having a thickness of between about 0.25 mm and about 0.76 mm (0.010 and 0.030 inches), (2) applying to said steel strip a hot-dip aluminum coating having a thickness of between about 25 um and about 89 μm (.001 and 0.003 inches) to provide between about 6 and 12 wt. % aluminum based on the weight of said foil, and (3) reducing the thickness of the hot-dip aluminum coated strip about 85–95% by cold rolling to form an aluminum coated steel foil having a thickness not substantially below about 0.038 mm and up to about 0.089 mm (0.0015 inches and 0.0035 inches).

8. A cold rolled aluminum coated steel foil as in claim 1, wherein at least one of said aluminum coatings has a thick surface coating of spine-like whiskers of aluminum oxide.

9. A foil as in claim 8 further characterized in that the foil is particularly adapted for use as a catalyst support in a catalytic converter for treating automotive exhaust gases, said aluminum oxide whiskers being suitable for retaining a surface coating comprising a noble metal catalyst.

10. A foil as in claim 9, wherein said foil is about 0.051 mm (0.002 inches) in thickness.

11. A foil as in claim 1, further characterized in that the foil is particularly adapted for use as a tool wrap for wrapping tools that are heated at an elevated temperature without being enclosed in a protective non-oxidizing atmosphere, said foil preventing objectionable oxidation and decarburization of the tool surface.

* * * * *